US007597586B2

(12) United States Patent
Huang et al.

(10) Patent No.: US 7,597,586 B2
(45) Date of Patent: Oct. 6, 2009

(54) MULTIPLE PIECES TYPE BNC AUTOMATIC TERMINATION CONNECTOR

(75) Inventors: Tung-Liang Huang, Hsin-Tien (TW); Sung-Wen Chen, Hsin-Tien (TW)

(73) Assignee: Insert Enterprise Co., Ltd., Hsin-Tien (TW)

( * ) Notice: Subject to any disclaimer, the term of this patent is extended or adjusted under 35 U.S.C. 154(b) by 0 days.

(21) Appl. No.: 12/076,605

(22) Filed: Mar. 20, 2008

(65) Prior Publication Data

US 2009/0197469 A1 Aug. 6, 2009

(30) Foreign Application Priority Data

Feb. 5, 2008 (TW) ..... 97202626 U

(51) Int. Cl.
*H01R 13/60* (2006.01)

(52) U.S. Cl. ..... 439/541.5

(58) Field of Classification Search ..... 439/540.1, 439/79, 541.5, 188, 668
See application file for complete search history.

(56) References Cited

U.S. PATENT DOCUMENTS

| | | | | |
|---|---|---|---|---|
| 5,613,880 | A * | 3/1997 | Wang | 439/620.03 |
| 7,014,503 | B1 * | 3/2006 | Wang | 439/581 |
| 7,186,138 | B2 * | 3/2007 | Wang | 439/541.5 |
| 2006/0172562 | A1 * | 8/2006 | Weidner | 439/63 |

* cited by examiner

*Primary Examiner*—Phuong K Dinh

(57) ABSTRACT

A multiple pieces type BNC automatic termination connector is constituted by coupling a housing to a set of BNC plugs, an insulating rear cover and a conducting ground. The rear cover is disposed with a post body corresponding to the pins of the BNC plugs. The post body is disposed with a plurality of long holes penetrating the upper and lower ends thereof. The pins pass through the long hole and extend to the lower side of the rear cover. The conducting ground is provided with a ground pin. Whereby, the number of ground pins and the assembly time can be reduced to enable the convenient and time-saving assembly due to no structures provided for retaining the pin and for assembling the pin with the housing.

8 Claims, 6 Drawing Sheets

MULTIPLE PIECES TYPE BNC AUTOMATIC TERMINATION CONNECTOR

BACKGROUND OF THE INVENTION

1. Field of the Invention

The present invention relates to a connector for signal transmission line, and more particularly to a multiple pieces type BNC automatic termination connector.

2. Description of Related Art

There are many patents concerning a dual type BNC connector. For example, Taiwan Patent No. M241844 entitled as "Dual type BNC connector", Taiwan Patent No. M270544 and U.S. Pat. No. 7,186,138 entitled as "Multiple pieces dual type BNC connector with all metal shell", Taiwan Patent No. M270543 and U.S. Pat. No. 7,014,503 entitle as "Multiple pieces dual type BNC connector", Taiwan Patent Publishing No. 267610 and U.S. Pat. No. 5,613,880 entitled as "Dual-plug BNC connector".

A plurality of conducting wires generally disposed at a rear end of a dual type BNC connector are not be retained by a shell, pins of the plurality of conducting wires are always not be aligned with a plurality of slots on a circuit board simultaneously, and spaces between a plurality of pins must be first adjusted and the pins can then be inserted into the plurality of slots during assembly; it wastes assembly labor and time. Furthermore, the plurality of conducting wires may not be parallel to one another very well (inclined to one another) such that the stability of the signal transmission is influenced and a short circuit is generated due to the mutual contact among them. Furthermore, because each BNC plug must be provided with a corresponding ground pin, more ground pins must be disposed when the multiple pieces dual type BNC connector is provided with multiple BNC plugs; the number pins will be increased to increase the assembly labor and time.

Taiwan Patent No. M270559 and US Pat. No. 7,186,139 comprises a coaxial connector with all metal shell comprising a metalwork casing in which at least one positioning hole is disposed; an insulator being accepted in said positioning hole; a terminal being accepted in said insulator; a rear receiving room being disposed at the rear end of said casing; a breach being disposed at one flank side of said rear receiving room; an insulating tenon being combined at the inside of the said breach of said rear receiving room; said insulating tenon having a plurality of through holes; at least one ground at the rear end of said casing and a lead wire at the rear end of said terminal being extended out of said casing after being respectively passed said through holes whereby, said ground and the portion of said lead wire at the rear end of said terminal passed out of said through holes are allowed to position.

The lead wire at the rear end of the terminal can be retained through the through hole of the insulating tenon, but the insulating tenon and a metal cover coupled to the casing are not integrated and need to be manufactured individually; it rather wastes the cost. Furthermore, the insulating tenon and the metal cover must be coupled to the casing separately; it rather wastes the assembly cost.

SUMMARY OF THE INVENTION

For improving a pin retaining structure of a multiple pieces BNC automatic termination connector and reducing the number of ground pins, the present invention is proposed.

The main object of the present invention is to provide a multiple pieces BNC automatic termination connector, simplifying a pin retaining structure to allow an assembly thereof to be more convenient and time-saving.

Another object of the present invention is to provide a multiple pieces type BNC automatic termination connector, used for reducing the number of ground pins to allow an assembly to be more convenient and time-saving.

Still another object of the present invention, allowing connecting conducting wires at a rear end thereof to be retained to be convenient for allowing pins of the plurality of connecting conducting wires to be respectively inserted into a plurality of slots on a circuit board simultaneously.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1A:
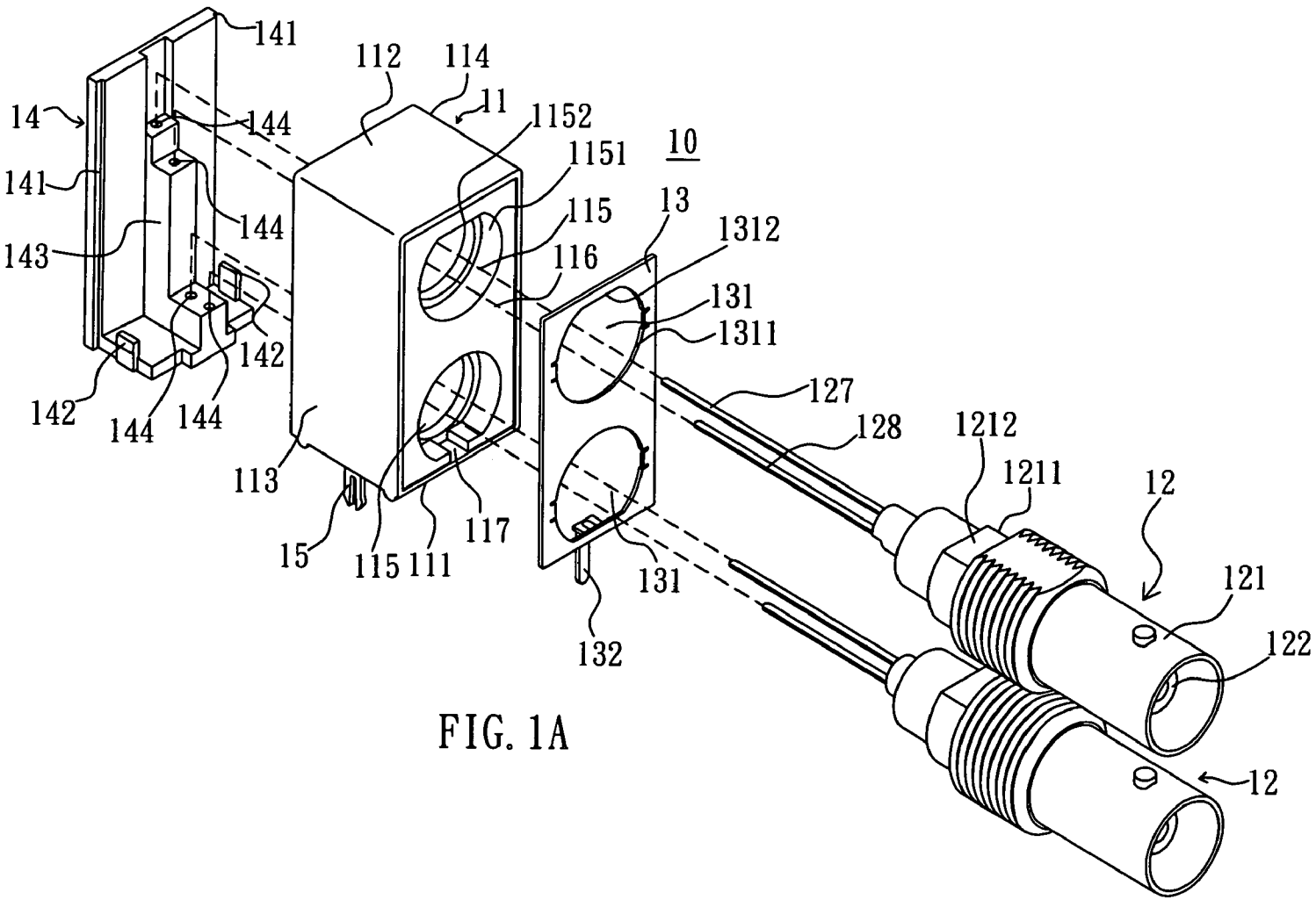
FIG. 1A is an exploded view, showing a multiple pieces type BNC automatic termination connector of a first preferred embodiment according to the present invention.
Figure 1C:
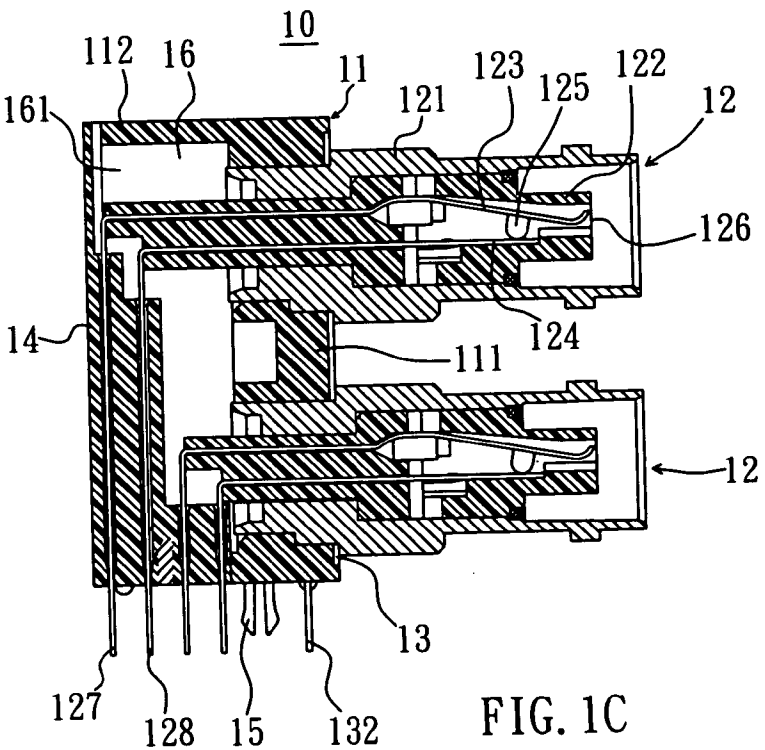
FIG. 1C is a cross sectional view, showing a multiple pieces type BNC automatic termination connector of the first embodiment according to the present invention.
Figure 1B:
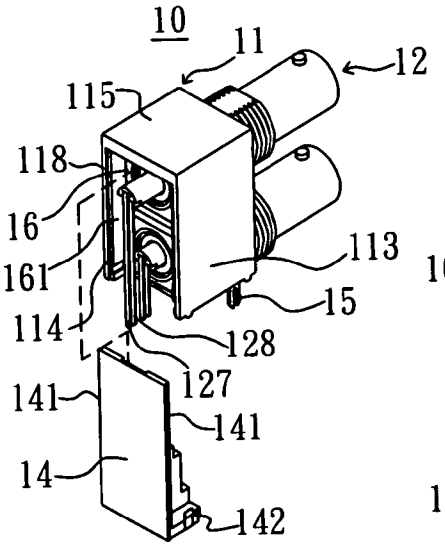
FIG. 1B is perspective view, showing a multiple pieces type BNC automatic termination connector of the first embodiment according to the present invention in which a housing thereof is not coupled to a rear cover.
Figure 1D:
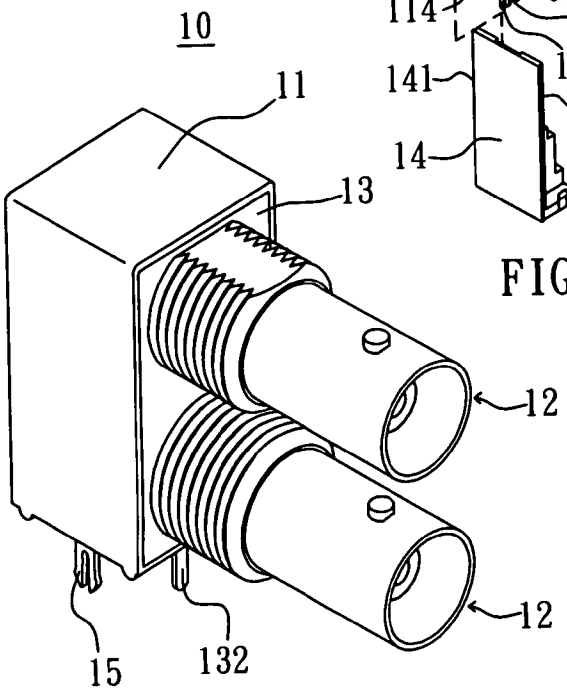
FIG. 1D is a perspective view, showing a multiple pieces type BNC automatic termination connector of the first embodiment according to the present invention.

Please refer to FIGS. 1A to 1E. A multiple pieces type BNC automatic termination connector 10 of a first preferred embodiment according to the present comprises an insulating housing 11, two BNC plugs 12, a conducting ground 13 and an insulating rear cover 14.

The housing 11 is disposed with a front wall 111 and a upper wall 112, a first side wall 113 and a second side wall 114 extend from the front wall 111 toward a rear side thereof. The front wall 111 is disposed two first through holes 115 side by side and vertically; a front end of the front wall 111 is disposed with a groove 116; a lower end of the front wall 111 is disposed a accepting groove 117 communicated with the lower through hole 115 and the groove 116; the lower end of the front wall 111 is further coupled to a insertion element 15.

Each BNC plug 12 comprises a metal shell 121, a hollow insulator 122, a first signal terminal 123 and a second signal terminal 124. The metal housing 121 is engaged with the insulator 122; an inner part of the insulator 122 is respectively coupled to the first terminal 123 and the second signal terminal 124. The first signal terminal 123 is disposed with a contact sheet 125 extended toward the second signal terminal 124. The contact sheet 125 is normally brought into contact with the second signal terminal 124 to allow the BNC plug 12 to have the function of automatic termination, but the contact sheet 125 is not brought into contact with the second signal terminal 124 any more when another signal terminal is inserted into a hole 126 disposed in front of the insulator 122 to contact the first signal terminal 123. A first pin 127 and a second pin 128 are respectively disposed on rear ends of the first signal terminal 123 and the second signal terminal 124. The first pin 127 and the second pin 128 are respectively extended downward from a rear end of the insulator 122. A part of the rear end of the insulator 122 coupled to the first signal terminal 123 is projected more rearward than a part thereof coupled to the second signal terminal 124 to cause the first pin 127 to be positioned at the rear of the second pin 128.

The conducting ground 13 is disposed with two second through holes 131 and a ground pin 132. The groove 116 accepts the conducting ground 13, and the ground pin 132 of the conducting ground 13 is placed in the accepting groove 117 and extended out of a lower side of the front wall 111. The first through hole 115 and the second through hole 131 are respectively engaged with a rear section 1211 of the metal shell 121. The rear section 1211 of the metal shell 121 and a wall 1151 of the first through hole 115, a wall 1311 of the second through hole 131 are respectively disposed with corresponding interference sections 1212 and 1152, 1312 to allow the metal shell 121 not to be rotated after being placed in the first through hole 115 and the second through hole 131. Because the metal shells 121 of the two BNC plugs 12 are brought into contact with the conducting ground 13, they can share the ground pin 132 and the disposition of two ground pins is unnecessary so that the number of ground pins and assembly time can be reduced to allow the assembly to be more convenient and time-saving.

The insulating rear cover 14 is L-shaped to correspond to and shield an opening 161 of the accepting groove 16 formed by rear sides of the front wall 111, the upper wall 112, the first side wall 113 and the second side wall 114, and combines with the housing 11 as a single piece. Two sides of the rear cover 14, the first side wall 113, and the second side wall 114 are respectively disposed with corresponding first retaining elements 141 and 118, for example, corresponding projecting rails and guide grooves. The bottoms of the two sides of the rear cover 14 are respectively disposed with a second retaining element 142 respectively, for example, engaging tenons, for engaging with the first side wall 113 and the second side wall 114. The rear cover 14 are further disposed with an L-shaped post body 143 corresponding to the first pin 127 and the second pin 128. The post body 143 is disposed with a plurality of long holes 144 penetrating the upper and lower ends thereof such that the first pin 127 and the second pin 128 are capable of passing through the long holes 144 and extending to the lower side of the rear cover 14 for being retained at a specific position respectively. In this way, it is convenient for the pins of the multiple pieces type BNC automatic termination connector 10 to be inserted into the slots provided at a circuit board.

The rear cover 14 is provided with a structure of retaining the first pin 127 and the second pin 128 concurrently such that a further structure of retaining the first pin 127 and the second pin 128 is unnecessarily disposed and another structure for allowing the housing 11 to assemble and retain the first pin 127 and the second pin 128 is unnecessary so as to enable the assembly to be more convenient and time-saving.

Figure 2A:
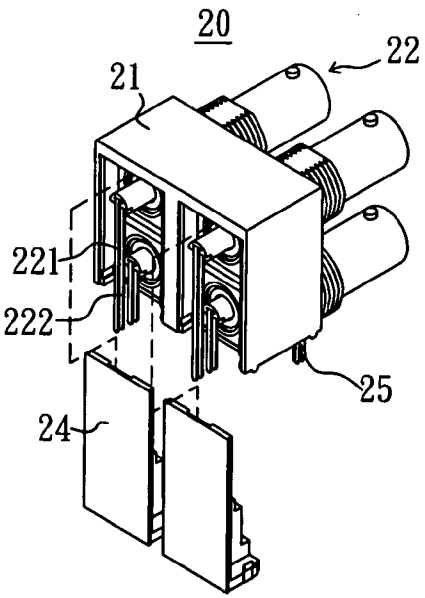
FIG. 2A is perspective view, showing a multiple pieces type BNC automatic termination connector of a second preferred embodiment according to the present invention in which a housing thereof is not coupled to a rear cover.
Figure 2C:
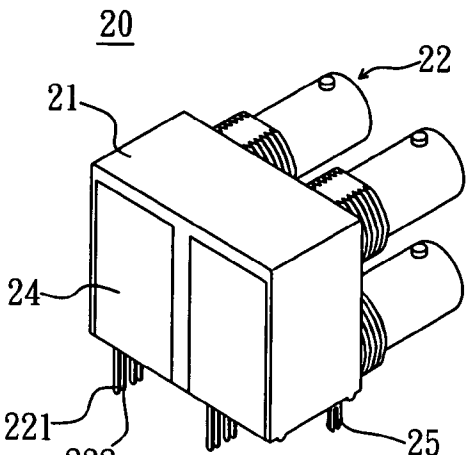
FIG. 2C is another perspective view, showing a multiple pieces type BNC automatic termination connector of the second embodiment according to the present invention.
Figure 1E:
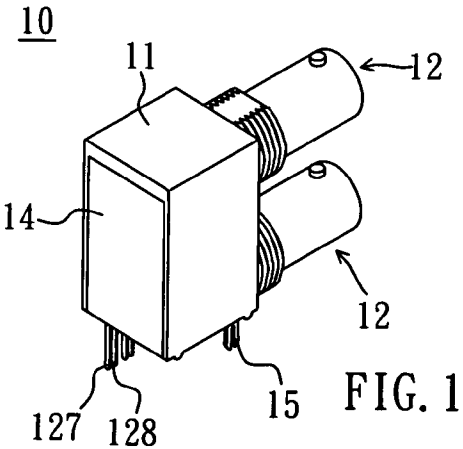
FIG. 1E is another perspective view, showing a multiple pieces type BNC automatic termination connector of the first embodiment according to the present invention.
Figure 2B:
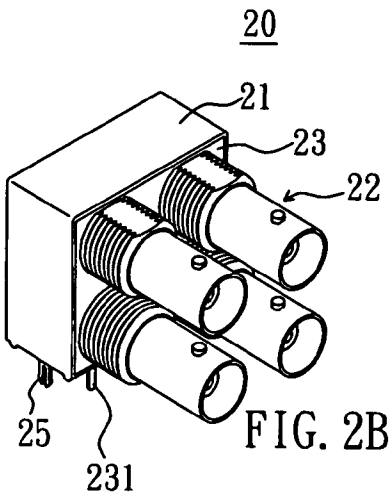
FIG. 2B is a perspective view, showing a multiple pieces type BNC automatic termination connector of the second embodiment according to the present invention.

Please refer to FIGS. 2A to 2C. A multiple pieces type BNC automatic termination connector 20 of a second preferred embodiment of the present invention comprises an insulating housing 21, four BNC plugs 22, a conducting ground 23 and two insulating rear covers 24. Structures of the BNC plug 22 of the second embodiment and the rear cover 24 are the same as structures of the BNC plug 12 and the rear cover 14 mentioned above; the housing 21 is also coupled to an insertion element 25, the conducting ground 23 is also disposed with a ground pin 231, not only a coupling structure of the BNC plug 22 and the housing 21, conducting ground 23 is the same as a coupling structure of the BNC plug 12 and the housing 11, conducting ground 13 mentioned above but a coupling structure of the rear cover 24 and the housing 21 is the same as a structure of the rear cover 14 and the housing 11 mention above and the only difference is that the housing 21 and the conducting ground 23 of the second embodiment are enlarged to be able to levelly couple two sets (first set and second set) of two BNC plugs 22 disposed side by side vertically. Furthermore, the housing 21 is disposed with three side walls; one rear cover 24 can be coupled to the two adjacent side walls.

The four BNC plugs 22 of the present embodiment can share one ground pin 231, the number of ground pins and the assembly time can be reduced to enable the assembly to be more convenient and time-saving. Furthermore, the rear cover 24 is provided concurrently with a structure for coupling pins 221 and 222, not only another structure for retaining to the pins 221 and 222 is unnecessarily disposed but another structure for allowing the housing 21 to assemble and retain the pins 221 and 222 is unnecessary to cause the assembly to be more convenient and time-saving.

Figure 3B:
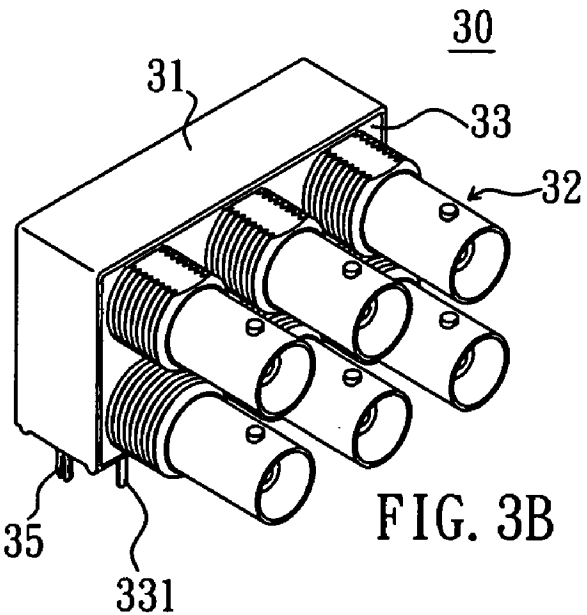
FIG. 3B is a perspective view, showing a multiple pieces type BNC automatic termination connector of the third embodiment according to the present invention.
Figure 3A:
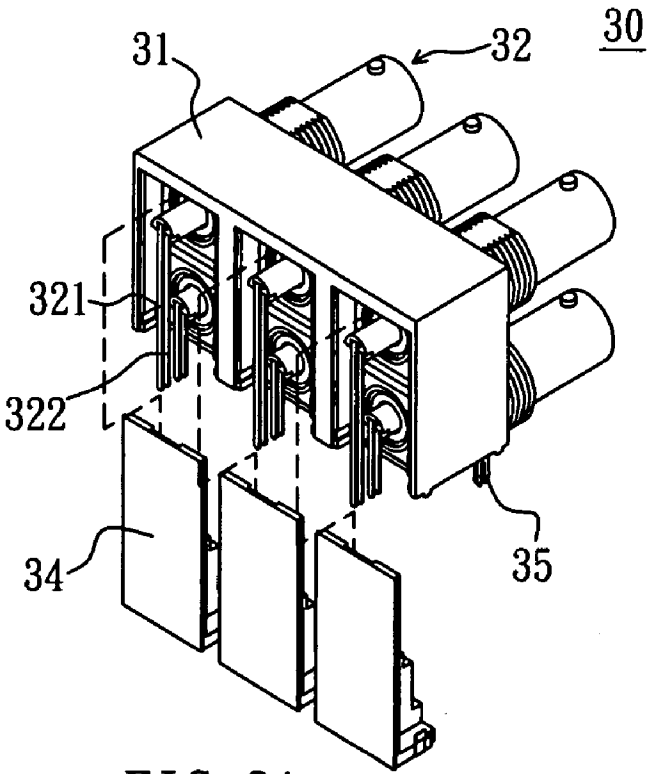
FIG. 3A is perspective view, showing a multiple pieces type BNC automatic termination connector of a third preferred embodiment according to the present invention in which a housing thereof is not coupled to a rear cover.
Figure 3C:
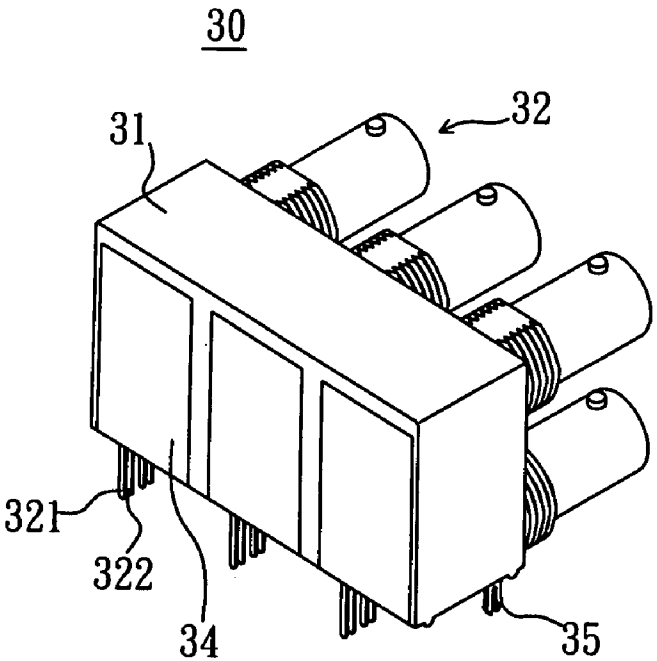
FIG. 3C is another perspective view, showing a multiple pieces type BNC automatic termination connector of the third embodiment according to the present invention.

Please refer to FIGS. 3A to 3C. A multiple pieces type BNC automatic termination connector 30 of a third preferred embodiment of the present invention comprises an insulating housing 31, six BNC plugs 32, a conducting ground 33 and three insulating rear covers 34. Structures of the BNC plug 32 of the second embodiment and the rear cover 34 are the same as structures of the BNC plug 12 and the rear cover 14 mentioned above; the housing 31 is also coupled to an insertion element 35, the conducting ground 33 is also disposed with a ground pin 331, not only a coupling structure of the BNC plug 32 and the housing 31, conducting ground 33 is the same as a coupling structure of the BNC plug 12 and the housing 11, conducting ground 13 mentioned above but a coupling structure of the rear cover 24 and the housing 21 is the same as a structure of the rear cover 14 and the housing 11 mention above and the only difference is that the housing 31 and the conducting ground 33 of the third embodiment are enlarged to be able to levelly couple to three sets of two BNC plugs 32 disposed side by side vertically. Furthermore, the housing 31 is disposed with four side walls; one rear cover 34 can be coupled to the two adjacent side walls.

The six BNC plugs 32 of the present embodiment can share one ground pin 331, the number of ground pins and the assembly time can be reduced to enable the assembly to be more convenient and time-saving. Furthermore, the rear cover 34 is provided concurrently with a structure for coupling to pins 321 and 322, not only another structure for retaining the pins 321 and 322 is unnecessarily disposed but another structure for allowing the housing 31 to assemble and retain the pins 321 and 322 is unnecessary to cause the assembly to be more convenient and time-saving.

Figure 4A:
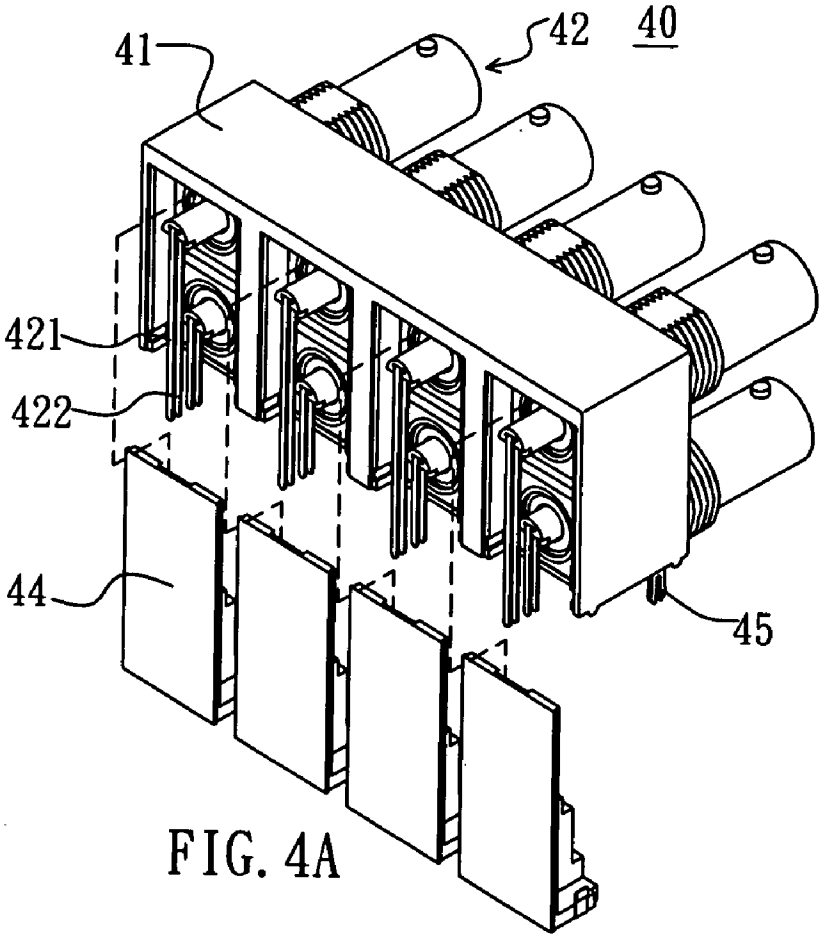
FIG. 4A is perspective view, showing a multiple pieces type BNC automatic termination connector of a fourth preferred embodiment according to the present invention in which a housing thereof is not coupled to a rear cover.
Figure 4C:
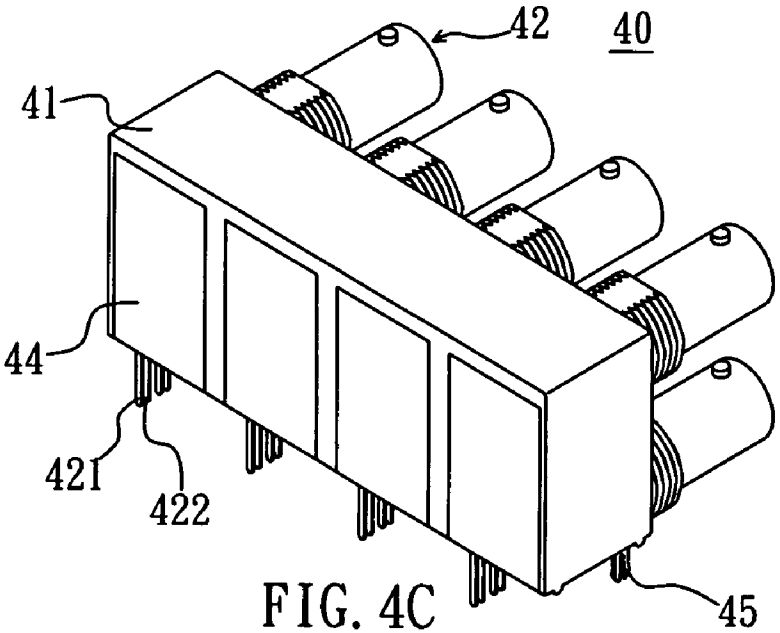
FIG. 4C is another perspective view, showing a multiple pieces type BNC automatic termination connector of the fourth embodiment according to the present invention.
Figure 4B:
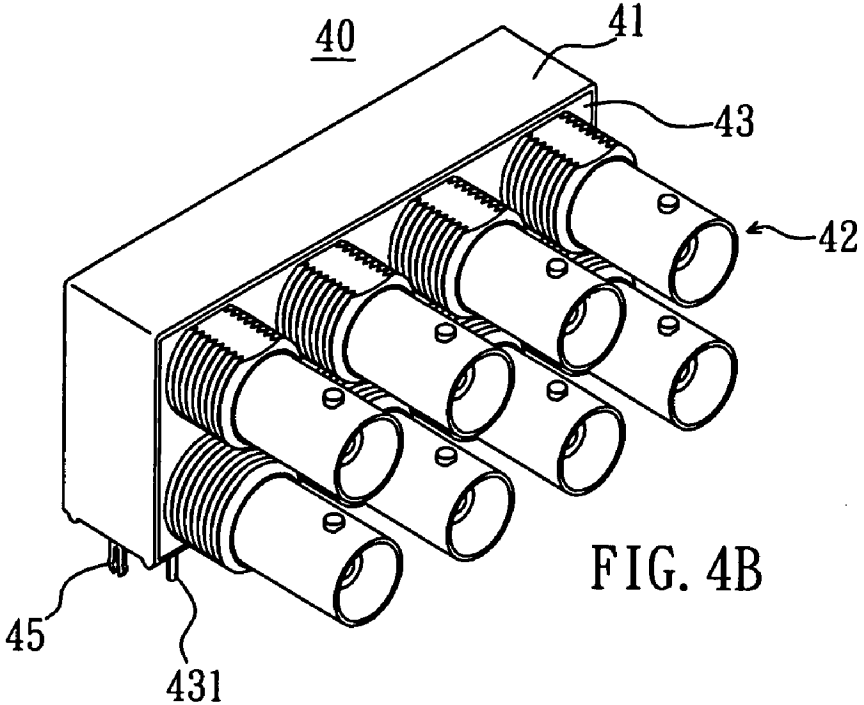
FIG. 4B is a perspective view, showing a multiple pieces type BNC automatic termination connector of the fourth embodiment according to the present invention.

Please refer to FIGS. 4A to 4C. A multiple pieces type BNC automatic termination connector 40 of a fourth preferred embodiment of the present invention comprises an insulating housing 41, eight BNC plugs 42, a conducting ground 43 and four insulating rear covers 44. Structures of the BNC plug 42 of the fourth embodiment and the rear cover 44 are the same as structures of the BNC plug 12 and the rear cover 14 mentioned above; the housing 41 is also coupled to an insertion element 45, the conducting ground 43 is also disposed with a ground pin 431, not only a coupling structure of the BNC plug 42 and the housing 41, conducting ground 43 is the same as a coupling structure of the BNC plug 12 and the housing 11, conducting ground 13 mentioned above but a coupling structure of the rear cover 44 and the housing 41 is the same as a structure of the rear cover 14 and the housing 11 mention above and the only difference is that the housing 41 and the conducting ground 43 of the second embodiment are enlarged to be able to levelly couple to four sets of two BNC plugs 32 disposed side by side vertically. Furthermore, the housing 31 is disposed with five side walls; one rear cover 44 can be coupled to the two adjacent side walls.

The eight BNC plugs 22 of the present embodiment can share one ground pin 431, the number of ground pins and the assembly time can be reduced to enable the assembly to be more convenient and time-saving. Furthermore, the rear cover 44 is provided concurrently with a structure for coupling to pins 321 and 322, not only another structure for retaining the pins 421 and 422 is unnecessarily disposed but another structure for allowing the housing 41 to assemble and retain the pins 421 and 422 is unnecessary to cause the assembly to be more convenient and time-saving.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A multiple pieces type BNC automatic termination connector comprising:

a housing disposed with a front wall, a upper wall extending rearward from said front wall, and at least two side walls, wherein said front wall is disposed at least a set of first through holes and two of said first through holes are disposed side by side vertically;

at least a set of BNC plugs, wherein two of said BNC plugs are provided with an automatic termination function, each of said BNC plugs comprises a metal shell and two pins, and each of said pins extends from a rear end of the respective BNC plug to a lower side of the respective BNC plug;

at least an L-shaped insulating rear cover being coupled to said housing, and disposed with an L-shaped post body corresponding to said pins, wherein said post body has an upper end and a lower end with a plurality of long holes penetrating said upper and lower ends;

wherein said housing is coupled to said set of BNC plugs, said through holes are respectively engaged to said metal shells, said pins respectively pass through said long holes and extend out of a lower side of said rear cover.

2. The multiple pieces type BNC automatic termination connector according to claim 1 further comprises a conducting ground, which is disposed with a ground pin, coupled to said metal shells with said ground pin being positioned in an accepting slot,. which is disposed at said front wall, and extending out of a lower side of said front wall.

3. The multiple pieces type BNC automatic termination connector according to claim 2, wherein said rear cover is corresponding to an opening of at least one accepting groove formed by the rear sides of said front wall, said upper wall and said at least two side walls to shield said opening with two sides of said rear cover and said side walls being respectively disposed with a corresponding first retaining element, and two sides of a bottom of said rear cover being respectively disposed with a second retaining element for being engaged to said side walls.

4. The multiple pieces type BNC automatic termination connector according to claim 3, wherein said conducting ground is disposed with at least a set of second through holes, and two of said second through holes are disposed side by side vertically to respectively engage with said metal shell.

5. The multiple pieces type BNC automatic termination connector according to claim 4, wherein said first through holes and said second through holes are respectively engaged with a rear section of the respective metal shell, and said rear section, a wall of the respective first through hole and a wall of the respective second through hole are respectively disposed with a corresponding interference section.

6. The multiple pieces type BNC automatic termination connector according to claim 5, wherein a front end of said front wall is disposed with a groove accepting said conducting ground and communicating with said accepting slot, which communicates with said first through hole positioned at a lower end of said front wall.

7. The multiple pieces type BNC automatic termination connector according to claim 6, wherein the respective BNC plug comprises a hollow insulator engaging with said metal shell and a first and second signal terminals being respectively coupled to said insulator, and said first signal terminal is disposed with a contact sheet extending toward said second signal terminal with a respective rear end of said first signal terminal and said second signal terminal forming said two pins.

8. The multiple pieces type BNC automatic termination connector according to claim 7, wherein said two pins respectively extend downward from a rear end of said insulator, and a part of said rear end of said insulator coupled to said first signal terminal is projected out more rearward than a part thereof coupled to said second signal terminal.

* * * * *